US005632604A

United States Patent [19]

Poothodiyil

[11] Patent Number: 5,632,604

[45] Date of Patent: May 27, 1997

[54] DOWN HOLE PRESSURE PUMP

[75] Inventor: Sathyanarayanan Poothodiyil, Lubbock, Tex.

[73] Assignee: Milmac, Lubbock, Tex.

[21] Appl. No.: 355,833

[22] Filed: Dec. 14, 1994

[51] Int. Cl.[6] ..... F04B 17/00

[52] U.S. Cl. ..... 417/225; 417/403

[58] Field of Search ..... 417/225, 400, 417/403; 91/25

[56] References Cited

U.S. PATENT DOCUMENTS

| | | | |
|---|---|---|---|
| 2,231,307 | 2/1941 | Wallace | 417/225 |
| 2,532,679 | 12/1950 | Slater | 417/403 X |
| 2,687,694 | 8/1954 | Conrad | 417/225 |
| 2,799,226 | 7/1957 | Kangas | 417/400 X |
| 4,051,877 | 10/1977 | Fletcher | 417/225 X |
| 4,234,295 | 11/1980 | Jensen | 417/403 X |
| 4,601,642 | 7/1986 | Andrews | 417/225 |
| 4,627,794 | 12/1986 | Silva | 417/225 |
| 4,738,599 | 4/1988 | Shilling | 417/400 |
| 5,249,645 | 10/1993 | Wiklund | 417/400 X |
| 5,328,339 | 7/1994 | Jong | 417/403 |
| 5,353,870 | 10/1994 | Harris | 417/400 X |

FOREIGN PATENT DOCUMENTS

| | | | |
|---|---|---|---|
| 86/03262 | 6/1986 | WIPO | 417/400 |

OTHER PUBLICATIONS

Peters, A.D., Pentrators, Inc., The Lance sm Formation Pentrator System, S.W. Petrol. Short course Form, S.E. and Secor, G.A., The Mechancis of Rock Failure Due to Water Jet Impingement; SPE 4247.

Sutherland, J.A., Increasing Water–Drilling Hydraulics Held . . . ; Oil & Gas Journal, Jul. 1991, pp. 91–94.

T. Butler, et al; A Method for Combined Jet and Mechanical Drilling;; SPE 20460.

Cure, M., Fontana;, P.;Jet–assisted drilling nears commercial use; Oil & Gas Journal, pp. 56–66.

Summers, D.A., and Henry, R.L. Water Jet Cuttin of Rock With and W/O Mech. Assist.; SPE3533.

Iyoho, A.W., Summers, D.A., et al Petroleum Appl. of Emerging High —Pressure Waterjet Tech; SPE26347.

*Primary Examiner*—Richard E. Gluck

*Attorney, Agent, or Firm*—Matthews & Associates

[57] ABSTRACT

The present invention utilizes a combined dual piston and cylinder arrangement surrounded by a sleeve all mounted within a container which is in turn placed within a drill collar. The pressure of the drilling mud within the drill string drives the pressure pump of the present invention by forcing the piston up and down. Stops on the piston rod maneuver a sleeve which opens and closes inlets and outlets so that the desired flow can be obtained to drive the cylinder, piston and rod arrangement up and down. When the pistons are driven downward, drilling mud is forced through a conduit into a drill bit and out a jet nozzle at a high pressure so as to facilitate the fracturing and removal of the formation being drilled.

8 Claims, 10 Drawing Sheets

DOWN HOLE PRESSURE PUMP

BACKGROUND OF THE INVENTION

Drilling technology has an increasing role in the future economy of crude oil and natural gas. Especially deep drilling has a large potential when the natural gas reserves are considered. A large portion of the remaining natural gas reserves exist at deeper depths where oil is no longer the primary target. Considerable deeper drilling of present oil wells may be required to explore deeper gas fields.

In the recent past, several investigators have dedicated their energy and time to adapt new and unusual techniques to solve the various problems encountered in oil well drilling. The alternative techniques included are explosives, percussion, chemical, water jet, abrasive fluid jet, melting, and thermal spallation methods. Evaluations were based on specific energy per foot drilled, penetration rates, compatibility with cuttings removal and well control operations. Each of these alternative methods have at least one major deficiency, namely explosives create a uncontrollable hole size and cutting removal is more difficult. Ballistic percussion is very energy efficient in large scale mining but difficult to implement and less efficient in performance in the small bore, mud filled deep wells. Thermal spallation does not work well in most sedimentary rocks. Rock comminution theory, along with current drilling practice, indicates better performance for drag and shear cutting methods over roller cone percussion bits for breaking rock as rock stress increases with depth.

Use of slim hole drilling and down hole motors has been increasing for several reasons. Slim holes drill quickly and cost less due to lower costs of bits, casing, rigs, mud, and crews. Down hole motors offer more efficient use of energy and better directional control. Factors important to the use and development of these techniques are drilling string strength, directional control for top driven systems, down hole motor service life, and removal of abrasive from mud before it is re-circulated.

David A. Summers and Richard L. Henry of University of Missouri-Rolla have done studies in the laboratory to evaluate the specific energy requirements for water jet cutting of rock with and without mechanical assistance. These studies are described in Water Jet Cutting of Rock With and Without Mechanical Assistance, Paper No. 3533, SPE 46th Annual Fall Meeting, New Orleans, Oct. 3–6, 1971. The relative efficiencies were evaluated in the pressure range of 5,000 psi to 25,000 psi. Water jets were alone utilized in the first case for rock removal, and in the second water jets were allowed to cut slots and the ridges were removed with a mechanical cutter. A high pressure jet nozzle of diameter 0.023 in. was used on samples of Berea sandstone and Indiana limestone.

A.W. Iyoho discusses the various applications of high pressure water jet rock removal technology in geothermal wells, underground mining, drilling in coal, environmental applications, horizontal wells, re-entry wells, coiled tubing applications, and enhanced oil recovery in Petroleum Applications of . . . . The use of high pressure jet technology requires sophisticated equipment, control systems, and expensive delivery system. So the recent trend in research is to combine relatively low pressure jets (5000 psi) with mechanical drilling. The water jets used are abrasive laden to improve the performance and rate of penetration. The energy of the high pressure jet is rapidly reduced as the depth increases due to the need to overcome the energy of the fluid that exists the hole. This problem was solved by introducing the jets in pulses and directing the rotating jet in a slightly offset angle.

The high pressure jet generally tries to enter any mechanical flaws in the rock face and further weaken the rock face and remove the dislodged particles. Other mechanisms of rock removal relevant to high pressure jet drilling are discussed. Results prove that with mastery attained in this emerging technology, reliable equipment, and experience, the area of horizontal oil well drilling will be a potential candidate. The tool is well suitable for drilling short radius wells and is also suitable for drilling a number of radials from a single well bore. The main reason for this is the necessity of low weight on bit due to the combined action of two processes: viz. mechanical drilling and the abrasive laden high pressure jet. The constraints on weight on bit for the directional control in deviated and horizontal drilling is completely eliminated. The low weight on bit enables a better control on the hole angle. Bechtel has attempted to drill a lateral hole off a previously drilled vertical hole. Coiled tubing was used with jet heads. The tool was advanced not by the weight on bit but by jet pressure and injection force.

Alan D. Peters of Penetrators, Inc. discusses another interesting application, of drilling small diameter radial holes to penetrate the damaged zone around a producing well bore in his article, The Lance Formation Penetration System, Southwestern Petroleum Short Course, 1990. The tool named Lanse$^{SM}$ Formation Penetrator activates itself down hole when pressurized. With the application of 10,000 psi, a steel punch from the tool punches a hole in the casing. Immediately, a jet from the lance provided cuts through the cement sheath and proceeds drilling a small pilot hole into the damaged formation. As drilling progresses, the lance extends horizontally into the formation up to a length of 10 feet. The discharge used was 20 gallons per minute of clean fluid. Once drilling is over the pressure is reduced to retract the lance into the tool. Peters' paper again proves the tremendous potential of jet cutting in the drilling industry.

Mike Cure of Grace Drilling Company and Pete Fontana of FlowDril Corp. have commercially realized a technology to combine jet and mechanical drilling. This technology is described in the Oil & Gas Journal, Mar. 11, 1991, pp. 56–66. The system consisted of a ultra high pressure pump on the surface to pressurize 20–30 gallons of mud a minute and deliver it to special high pressure nozzles on the bit through a small diameter piping running down inside the drill pipe and drill collars from the surface to the bottom. Considerable changes in surface equipment and down hole tubular were necessary for this system. The gooseneck, swivel, kelly, drill pipes and drill collars were modified to accommodate the dual pipe system.

The Cure set up involves an elaborate arrangement of surface equipment. FIG. 1 gives a detailed ideal of the setup. The surface equipment mainly consists of a drilling fluid condition equipment, ultra high pressure pumps, isolator, and the necessary piping to delivery the clean high pressure mud to the drill string. The drill string consists of the same equipment as found on a conventional rig namely, swivel, kelly, drill pipe, drill collars, stabilizers, subs, and other bottom hole assemblies. The swivel, kelly, drill pipe, drill collars, stabilizers, subs and other bottom hole assemblies are modified to accommodate the dual pipe system. In other words all these pieces of equipment accommodate an inner high pressure tubing of diameter 1.625" OD. This tubing runs down the center of the drill string from the surface to the bit, and exits to special high pressure nozzles situated on the bit. The bit accommodates both, the three conventional nozzles and the special high pressure nozzles for jet cutting. Only 20 to 30 gal/min of mud is pressurized with the ultra high pressure pump for the sake of jet drilling. Approximately 400 gal/min of mud is pumped into the drill string with the conventional mud pumps. Therefore two mud streams assist, one the 20 to 30 gal/min of clean pressurized mud, and the other 400 gal per min of regular mud. The high pressure mud flows through the inner high pressure tubing and the regular mud flows through the annulus between the drill string and the inner tubing. Both of these streams on exiting through their respective nozzles mix together in the annulus and return to the surface with the cutting. The high pressure jet would assist the normal mechanical drilling which is due to rotating drill string and weight on bit.

The drilling fluid conditioning equipment conditions the mud and cleans it of all abrasive materials. This clean fluid ensures long life of the ultra high pressure pump. The ultra high pressure pump is a critical part because of the amount of pressure it generates (35,000 psi). This clean fluid prevents the mud cut of the pump which is otherwise a normal occurrence in the conventional mud pumps. This cleaning equipment pressurizes only 20 to 30 gal/min of mud since this is the quantity required for jetting action.

The ultra high pressure pump as shown in FIG. 3.2 is truck mounted and is mechanical crankshaft driven. These pumps require 600–800 bhp. Because of the high pressure, any suspended abrasive particle is removed by the cleaning equipment before it passes through the pump.

The drill string contains a inner tubing to deliver the high pressure mud from the surface to the bit. This tubing is made of berryllium—copper alloy and the centralizer design ensures the tubing's entire stabilization in the 5 inch drill pipe. Berryllium—copper alloy was chosen as it is more resistant to chloride stress cracking. The life of this tubing goes beyond that of the drill pipe. The connections are so designed that, when the drill pipe connections are made, automatically the inner tubing gets connected.

In spite of the impressive results obtained in these test wells some drawbacks do lie in this system. Some of the important disadvantages in this system are listed as follows:

1. Increased Rig installation costs. The surface equipment necessary viz. the drilling fluid condition equipment, the ultra high pressure pump, the modified swivel, tubular with the dual pipe, etc., are the extra investments a drilling company has to make.
2. The modified swivel has proven itself operational for only 160 hours at 20,000 psi to 30,000 psi.
3. Modifying wire line observation tools and all down hole tools like positive displacement motors, turbines, jars, etc., because of the dual pipes involved in this system will be very tedious and expensive.
4. Fishing operations will be more complicated.
5. The concentric high pressure tube within the drill pipe is laborious to install.
6. The stab seal design of the inner conduit cannot be completely dependable.

These drawbacks compel costly changes and modifications in drilling operations like fishing, deviation measurements, MWD, turbo drilling and horizontal drilling.

SUMMARY OF THE INVENTION

The main purpose of this invention is to eliminate all the drawbacks associated with the present system mentioned above. The goal was to eliminate all the extra paraphernalia used, namely, the mud cleaning equipment, the ultra high pressure surface pump, the modified swivel, the dual pipe tubular, and replace them with a single down hole tool about the length of a single joint of drill pipe. (30 feet).

This tool is essentially be a pressure intensifier located immediately above the bit. Based upon the inventors research and understanding of the technology, jet assisted mechanical drilling is easier and requires less energy than jet drilling without mechanical assistance. The present invention is intended to enhance the jet assistance utilized with mechanical drilling. In the present invention the drilling mud, apart from its other functions, will now have the additional function of eroding the formation below the bit. This technology has only been intermittently used in this industry for a variety of reasons. The biggest advantage to be realized for the present invention will be the increase in rate of penetration, or lesser time to drill a given well. The cost reduction will be proportionate to the reduction of drilling time. In the drilling industry even a few percent reduction in drilling time will realize thousands of dollars of savings. Bits can be run longer and its life span increased, which directly indicates fewer bits to drill a well and costly bits can thus be avoided. Since bits can be run longer, tripping time will be considerably reduced.

Deep drilling has its own disadvantages. More rotation time, low rate of penetration and consolidated hard formation, high tripping time and low footage attained by each bit. Since this tool aims at attacking these disadvantages, deep drilling will be one of the most suitable candidates for combined jet and mechanical drilling.

Many deep wells have been abandoned because of the hug monetary investments involved due to low rate of penetration observed at greater depths. Further drilling could have been thus abandoned. These wells can be a very suitable candidate for this technology. Higher rates of penetrations, fewer number of bits, lesser tripping time, and the overall reduction in drilling time will definitely be a economic relief for the completions of these deep wells.

Another existing candidate will be horizontal wells, especially the short radius horizontal wells. The main difficulty faced in drilling short radius wells is the azimuth and inclination control The hole control becomes difficult due to the fact that penetration solely depends on the weight on bit and the forward advance of the drilling assembly. Incorrect weight on bit will definitely alter the hole profile and further in very short radius wells applying weight on the bit will become a Herculean task as the whole weight of the string would rest on the lower portion of the well bore. Another disadvantage is that the length of the horizontal section will be limited because, after a certain length, application of the weight on bit will become impossible.

With this tool, the jetting action can obtain penetration, and drilling will not solely depend on the weight on bit. Thus, the profile of the hole can be well maintained and longer horizontal sections can be drilled with less difficulty.

The kick off can be done with jetting action alone. The kick off zone can be under-reamed to accommodate a jetting tool to orient itself in the required direction. The drilling of the lateral portion can then be executed with a hybrid bit, the down hole tool, a down hole motor, and coiled tubing assembly.

The advent of this technology in horizontal drilling will certainly be a boon to enhanced oil recovery. Longer horizontal sections means fewer horizontal wells and tremendous cost savings in drilling the vertical sections of the extra wells. Radials can be more confidently attempted. This will create more efficient injection and production wells.

The present invention utilizes a combined dual piston and cylinder arrangement surrounded by a sleeve all mounted within a container which is in turn placed within a drill collar. The pressure of the drilling mud within the drill string drives the pressure pump of the present invention by forcing the piston up and down. Stops on the piston rod maneuver a sleeve which opens and closes inlets and outlets so that the desired flow can be obtained to drive the cylinder, piston and rod arrangement up and down. When the pistons are driven downward, drilling mud is forced through a conduit into a drill bit and out a jet nozzle at a high pressure so as to facilitate the fracturing and removal of the formation being drilled.

DETAILED DESCRIPTION OF THE PREFERRED EMBODIMENT

Figure 2:
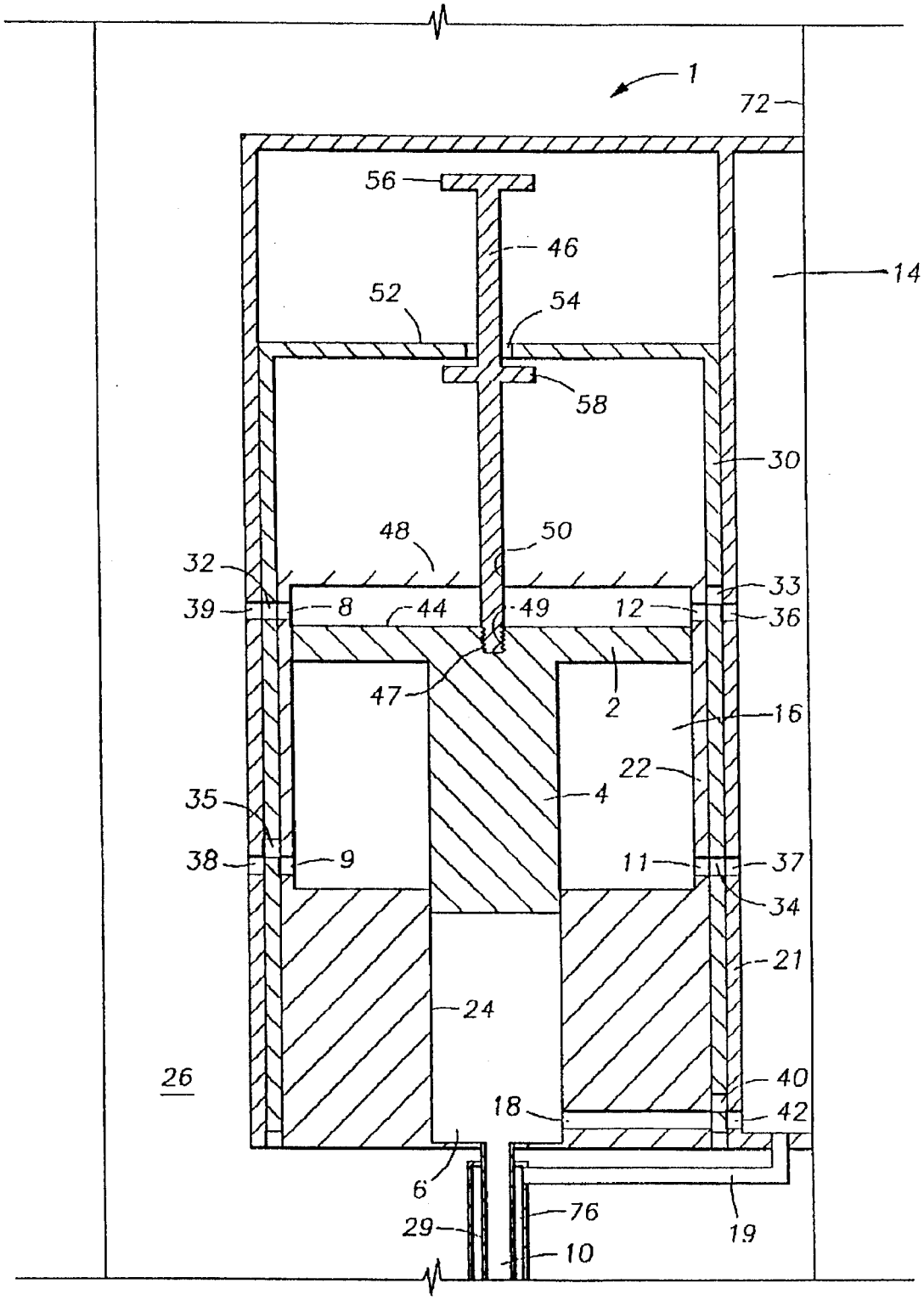
FIG. 2—Cross-sectional elevational view of the present invention.
Figure 3:
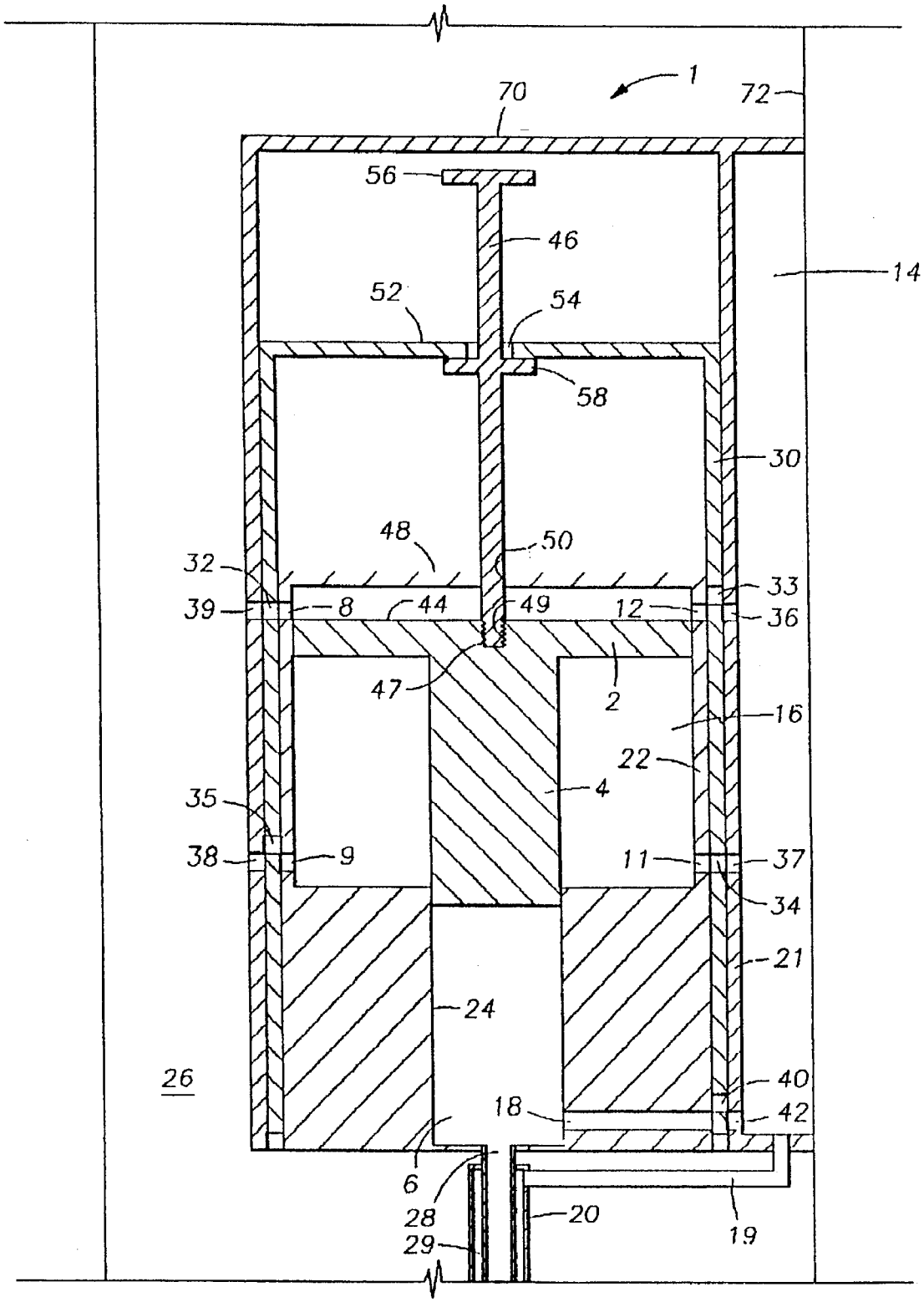
FIG. 3—Cross-section view of the present invention with piston at top dead center.

The down hole tool, basically a pressure intensifier, uses the concept of increasing pressure by employing a two-piston arrangement, a driving piston 2 of larger area, and a driven piston 4 of smaller area as shown in FIG. 2. The ratio in pressure increase will be moving in a first larger cylinder 16 and is the ratio of the two areas. The larger piston 2 will be driven by the pressure of the mud in the drill string. The smaller piston 4 moving in a small second cylinder 6 will suck in the normal drilling mud during its suction stroke and discharge it at higher pressure to the nozzles 10 in the drilling bit.

The inlet ports 8 and 9 to the bigger cylinder 16 will be open to the drilling mud so that the bigger driving piston 2 is driven by the hydrostatic pressure and operating pressure of the drilling mud. The outlet ports 11 and 12 of the drilling mud will communicate to a separate chamber 14. This chamber 14 will be open to the outlet ports 11 and 12 of the bigger cylinder 16, the inlet port of the smaller cylinder 18, and a special jet nozzle 10 on the bit (not shown). This will enable a part of the outlet drilling fluid from the bigger cylinder 16 to enter the inlet 18 of the smaller cylinder, and the rest of the fluid to exit the single nozzle 10 exclusively connected to the outlet 28 of cylinder 6.

This arrangement will be included because of the fact that the outlet from the bigger cylinder 16 cannot be opened to the inside of the drill string, as the pressure around this cylinder arrangement will be the same. The outlet ports 11 and 12 need to be communicated to a pressure lower than that at the inlet ports 8 and 9 to allow the motion of the piston. If the pressures at both the inlet and the outlet ports are equal, both the sides of the piston will be subjected to equal pressures, resulting in the stalling of the piston. It is for this reason that the outlet ports will be communicated to the outside of the drill string at the drill bit through conduit 19. Outside the drill bit (i.e., the annulus 20) only the hydrostatic head of the drilling mud column in the annulus 20 exists. This is lower than the pressure that exists inside the drill string. Inside the drill string, the pressure of the mud comprises the operating pressure of the mud pumps, and the hydrostatic pressure of the drilling mud column in the drill string. Therefore, the difference in pressure between the inside of the drill string and the annulus will be actually the pressure available to drive the piston. This pressure will be the operating pressure of the mud pumps. The hydrostatic head of the drilling mud inside the drill string that tends to power the piston 2 and 4 will be nullified by the back pressure at the outlet, which is the hydrostatic head of the drilling mud in the annulus. Since the hydrostatic pressure will be nullified, only the operating pressure of the mud pump will be available for powering the pistons 2 and 4.

The main cylinder wall 21 will incorporte both first and second cylinders 16 and 6, and will be one piece, with the upper part 22 having a larger diameter to accommodate the bigger cylinder 16 and piston 2, and the lower part 24 with a smaller diameter to accommodate the smaller cylinder 6 and piston 4. Both of the pistons 2 and 4 will be connected together and move only in their respective cylinder. The smaller piston 4 will be affixed at a central point of the large piston 2. The cylinders will have ports for the inlet 8 and 9 and outlet 11 and 12 will exit into the chamber 14. This chamber 14 will not be in communication with the drilling mud flowing down the drill string 26 and will be filled only with the outlet drilling mud from the bigger cylinder 16. This will isolate the chamber 14 from the drilling mud pressure inside the drill string 30. The smaller cylinder 6 again will have two ports, the inlet port 18 and the outlet port 28. The inlet port 18 will be connected to the chamber 14, so that during the suction stroke of the small piston 4, drilling mud will be sucked into the smaller cylinder 6 from this chamber 14. The outlet port 28 of the small cylinder 6 will be coaxial to the drill string and will be connected with a short pipe 29 to the nozzles 10.

The opening and closing of the inlet and outlet ports of the bigger cylinder will be achieved by providing a sleeve 30. This sleeve 30 which will be cylindrical in shape slides over the main cylinder wall 21. The inner diameter of the sleeve and the outer diameter of the cylinder will be the same. The sleeve will have ports 32–35 drilled on its circumference, and will be designed to remain in just two positions, one during the upstroke of the piston and the other during the down stroke of the piston. During the up stroke, only one set of ports 33 and 35 in the sleeve 30 will communicate with the respective ports 36 and 38 of the cylinder wall 21, to enable the drilling mud 26 in the drill string 31 to enter the cylinder 16 through the inlet port 9 situated below the larger piston 2 and push the piston up. Simultaneously, the drilling mud above the larger piston will be allowed to exit into the chamber 14, through the outlet ports 12, 33 and 36 situated above the larger piston 2. Similarly during the down stroke, another set of ports 32 and 34 of the sleeve 30 will be in communication with the respective ports 37 and 39 of the cylinder 21 to enable the drilling mud 26 in the drill string 31 to enter the cylinder 16 through the inlet port 39 situated above the larger piston 2 and push the piston down. Simultaneously, the drilling mud below the larger piston will be allowed to exit into the chamber 14, through the outlet ports 11, 34 and 37 situated below the larger piston 2.

The inlet port 18*m* of the smaller cylinder 6 will communicate to the chamber 14. The inlet port 18 will be operated by the same sleeve 30. It will allow flow of drilling mud only from the chamber 14 to the smaller cylinder 6 during the up stroke of the piston 4 and will not allow any flow from the cylinder 6 to the chamber 14 during the down stroke of the piston 4. During the up stroke, the sleeve 30 will be in its lower position and the inlet port 18 of the smaller cylinder 6 will be in communication with the chamber 14 through sleeve port 40 and chamber port 42. This will enable the drilling mud to enter the smaller cylinder 6 from the chamber 14, through the ports 18, 40 and 42. During the down stroke, the sleeve 14 will be in its upper position and the inlet port 18 of the smaller cylinder 6 will not be in communication with the chamber and so the highly pressurized mud will be discharged through the outlet port 28. The outlet port 28 should have a one way valve (not shown). The valve allows the pressurized drilling mud to flow from the smaller cylinder 6 to the nozzle 10 on the drill bit (not shown). This will have another function viz. in case of tool failure mud along with cuttings from the open hole will not enter the nozzle and plug it.

On the upper face 44 of the larger piston 2 will be threaded with a long thin cylindrical rod 46. The rod 46 will contain external threads 47 which will correspond to threaded aperture 49 of piston face 44. The rod 46 will be provided to shift the positions of the sleeve 30. The cylinder head 48 contains a circular aperture 50 in the center. The rod 46 exactly fits into this aperture 50 and projects out of the cylinder 16. This arrangement should be well sealed to prevent any leakage from or into the cylinder 16. The rod 46 also slides up and down through the aperture 50 during the up stroke and down stroke of the piston 2. The head 52 of the sleeve 30 again will also have a circular aperture 54 of diameter just larger than the diameter of rod 46. Rod 46 passes through aperture 54 on the sleeve head 52 and would freely move, as there will be ample clearance, through this opening 54 during the up stroke and down stroke of the piston 2. The rod 46 will have two stoppers 56 and 58 positioned, such that the opening in the sleeve head will be always between these two stopper. During the down stroke of the piston 2 the rod 46 will also move down. Just before reaching the bottom dead center, the upper stopper 56 on the rod 46 will start moving the sleeve 14 down. This downward motion of the sleeve 14 will continue till the piston 2 and 4 reaches the bottom dead center. When the piston 2 and 4 reach the bottom dead center the sleeve 30 will be completely moved and fixed in position. At this position, one set of port of the sleeve main cylinder and large cylinder 35, 38 and 9, will be in communication to allow the up stroke of the piston 2 and 4. During the up stroke, the top stopper 56 will move away from the sleeve head 52 while the bottom stopper 58 will move towards the sleeve head 52. Just before reaching the top dead center the bottom stopper 58 will start moving the sleeve 30 up. This upward motion of sleeve 30 will continue till the pistons 2 and 4 reach the top dead center. When the pistons 2 and 4 reach top dead center, the sleeve 30 will be completely moved and fixed in position. At this position, another set of ports of the sleeve, main cylinder and larger cylinder 32, 39 and 8 will be in communication to allow the down stroke of the piston. The whole process will be repeated. The sleeve 30 can be held in position with a ball spring arrangement.

Figure 1:
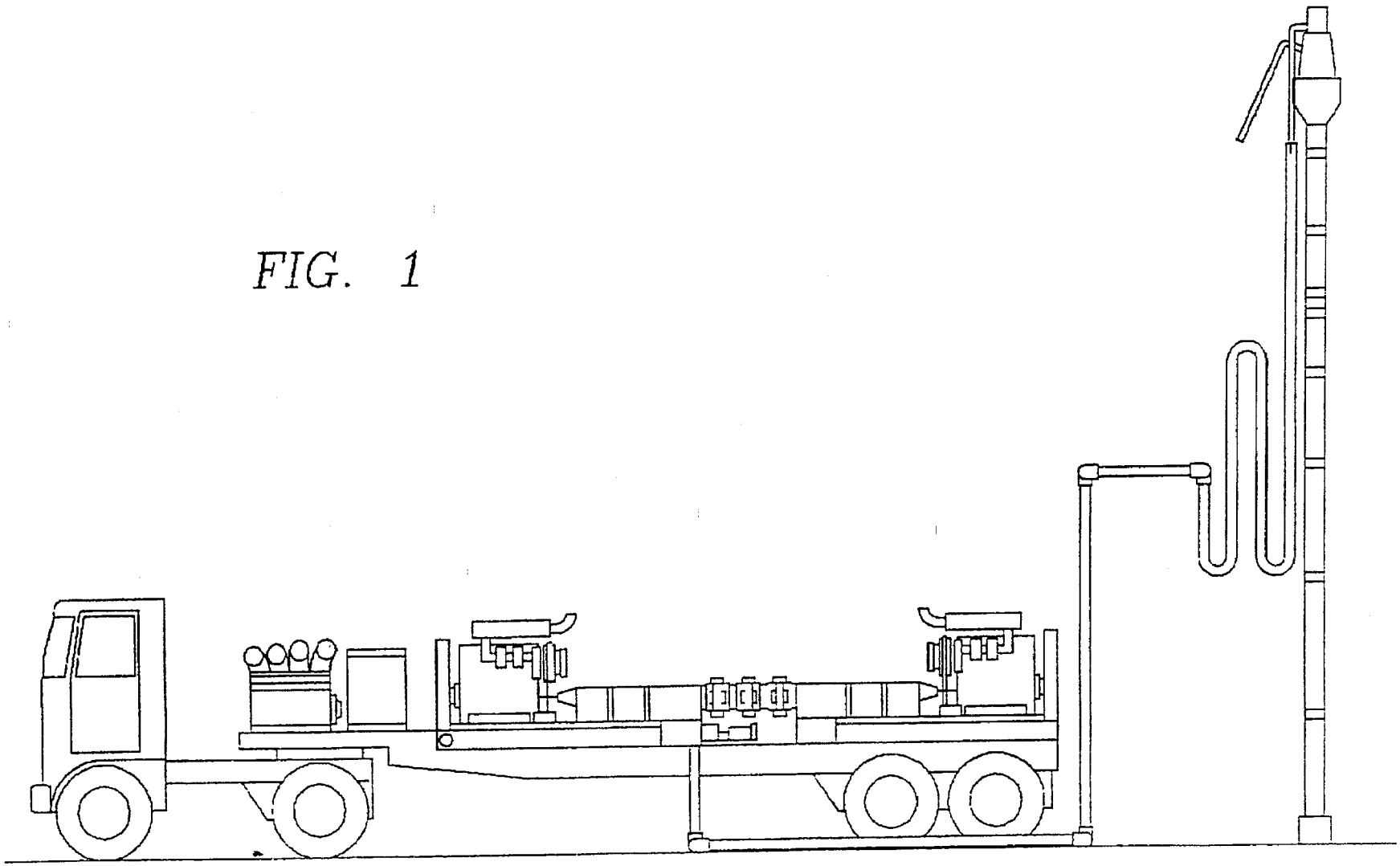
FIG. 1—Field setup view of prior art arrangement.

This whole arrangement as shown in FIG. 1 will be placed in a cylindrical shaped stationary container. This container 70 will be closed at the top and has an opening for the outlet of the chamber 14 and the high pressure outlet 28 from the smaller cylinder 6. This will completely enclose the portion above the cylinder head 48 and also the rod 46 that protrudes out of the cylinder head 52. Because of this container 70, the rod 14, the stoppers 56 and 58, and the opening 54 on the sleeve head arrangement 52 will be isolated from the drilling mud in the drill string. The sleeve 30 will be in close fit with this container 70 and will allow the sliding of the sleeve 30 in between this container 70 and the cylinder 6 and 16. The leakage between the sleeve 30 and the cylinders 6 and 16 and the sleeve 30 and the container 70 can be prevented by the inclusion of seals and o-rings (not shown). The container 70 will have ports 36, 37, 38 and 39 on its circumference in line axially with the inlet ports 8 and 9 and outlet ports 11 and 12 of the cylinder 16. The sleeve 30 in its two different positions will allow the communication of respective ports on the cylinders 6 and 16 and the container 70.

The chamber 14 will be adjacent to the housing 21, on the side of the outlet ports 11 and 12. The chamber 14 will be again cylindrical shaped with openings in line axially with the outlet ports 36 and 37 of the container 70. The outlets 12 and 12 of the cylinder 16 will serve as the chamber's inlet. Two outlets will be provided to the chamber 14, one will be the inlet 18 to the smaller cylinder 6 and the other will be to the opening on the drill bit.

It is to be understood the form of the invention herein shown and described is to be taken as a preferred example, and that numerous variations will be obvious to those skilled in the art in light of the teaches of this specification, without departing from the scope of the herein after claimed subject matter.

THE WORKING OF THE DOWN HOLE TOOL

The Ports and the Piston

Down Stroke

The ratio of decrease in the piston areas for pistons 2 and 4 will be the ratio of increase in the pressure. The pistons 2 and 4 will have a top dead center and a bottom dead center. Now consider the piston 2 at top dead center (see FIG. 2). The sleeve 30 will be in its upper position. The lower inlet ports 9, 35 and 38 and the upper outlet ports 12, 33 and 36 will be closed because of the position of the sleeve 30. The upper inlet ports 8, 32 and 39 and the lower outlet ports 11, 34 and 37 will be open. In this position, drilling mud in the drill string will enter the bigger cylinder 16 above the piston 2 and push the piston 2 down. Simultaneously the mud below the larger piston 2 will be forced out into the chamber 14 through the lower outlet ports 11, 34 and 37. The piston arrangement will continue its motion towards the bottom dead center. During its downward motion the smaller piston 4 forces highly pressurized drilling mud to special jet nozzles 10 on the drill bit.

Also at this position of the sleeve 30, the inlet port 18 of the smaller cylinder 6 will not be in communication with the chamber 14. Therefore, the pressurized mud is sent through the outlet port 28 of the smaller cylinder 6 to the special jet nozzles 10.

Up Stroke

Figure 4:
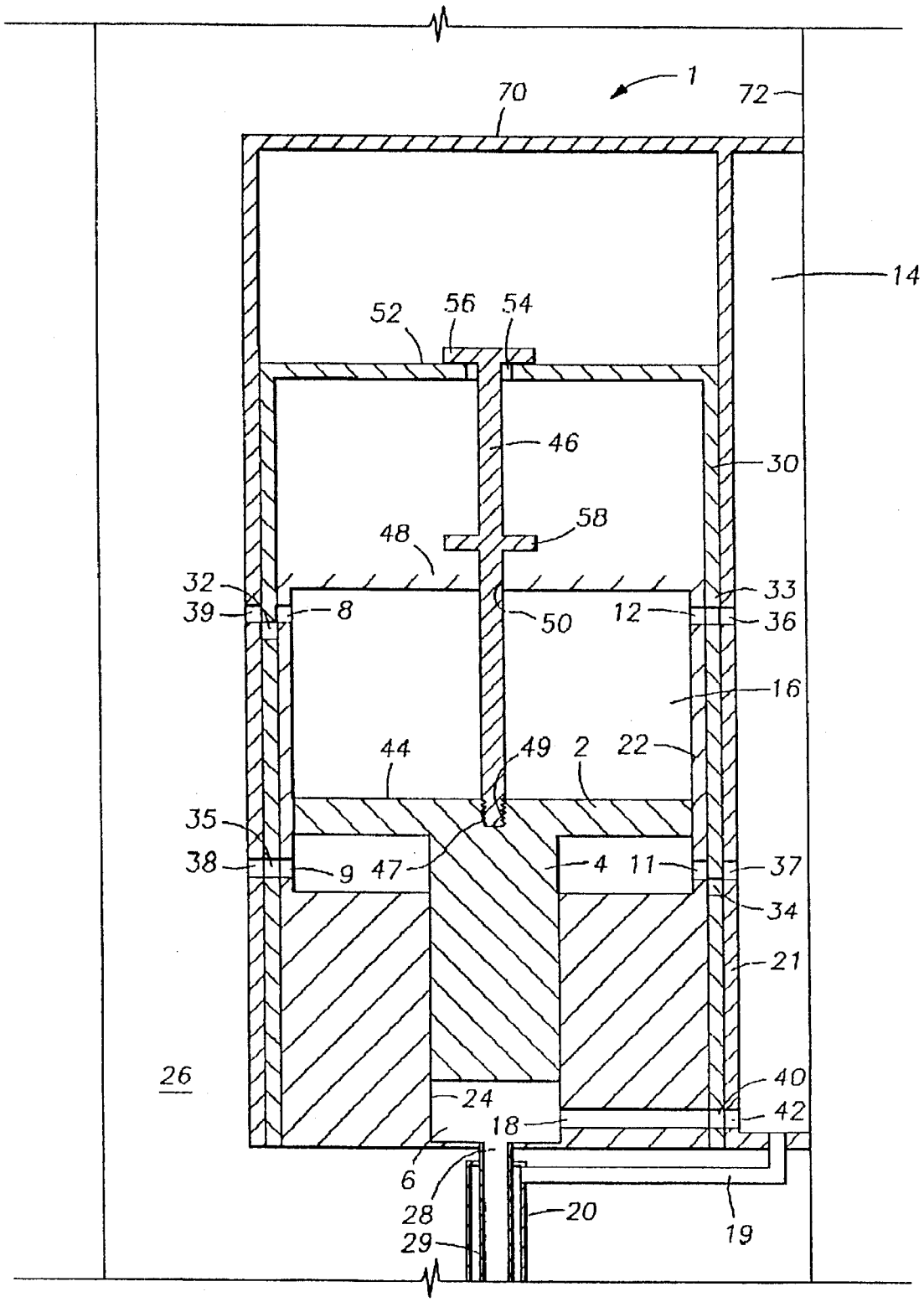
FIG. 4—Cross-sectional elevational of view of the present invention with piston at bottom dead center.

Now consider the bottom dead center (see FIG. 4). The sleeve 30 will be in its lower position. The upper inlet ports 8, 32 and 39 and the lower outlet ports 11, 34 and 37 will be closed because of the position of the sleeve. 30. The lower inlet ports 9, 35 and 38 and the upper outlet ports 12, 33 and 36 will be open. In this position, drilling mud 26 in the drill string will enter the bigger cylinder 16 below the piston 2 and push the piston 2 up. Simultaneously, the mud above the large piston 2 will be forced out into the chamber 14 through the upper outlet ports 12, 33 and 36. The piston arrangement will continue its motion towards the top dead center.

In this position of the sleeve 30, the inlet port 18 of the smaller cylinder 6 will be in communication with the chamber 14, enabling the drilling mud from the chamber 14 to enter the smaller cylinder 6. The mud entry will be facilitated by the reduction in pressure due to the upward movement of the smaller piston 4. A one-way valve provided just below the port 28 prevents any mud from entering the smaller cylinder 6 through the port 28.

The Sleeve Mechanism

The sleeve 30 will be moved into its position with the help of the stoppers 56 and 58 on the rod 46. One end of the rod will be threaded to the piston 2 with threads 47 and 49, so that the rod 46 will also move with the piston 2. When the piston 2 makes its upper or lower stroke, the stoppers 56 and 58 on the rod 46 will knock the sleeve 30 into its upper and lower positions respectively.

Up Stroke of the Piston

Figure 5:
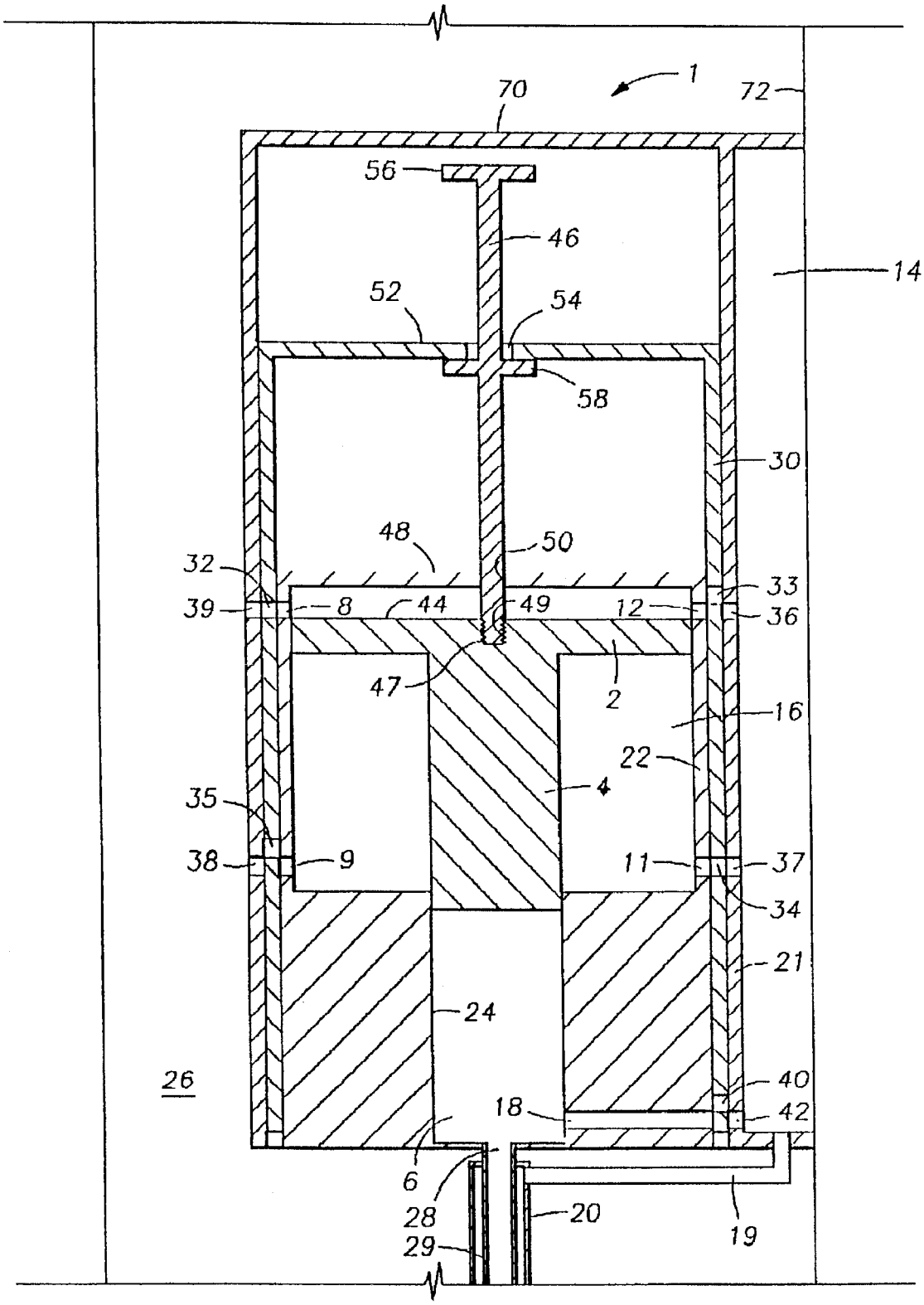
FIG. 5—Cross-sectional elevational view of the present invention with sleeve mechanism in upper most position.

As the rod 46 will be threaded to the piston face 44 via 47 and 49, it will slide through the cylinder head 48, upward during the up stroke of the piston (see FIG. 5). the lower inlet ports 9, 35 and 38 of cylinder 16 and inlet ports 18, 40 and 41 will be open. Drilling mud 26 from the drill string will enter the lower inlet port 9 and push the piston 2 up. Simultaneously, the drilling mud above the piston 2 will be forced out through the upper outlet ports 12, 33 and 36. Also, mud is sucked in from chamber 14 into smaller cylinder 6 through ports 18*m* 40 and 41. The piston now will move up, along with sliding rod 46 up through the cylinder head 48.

When the rod 46 moves up, the upper stopper 56 of the rod 46 will move away from the sleeve head 52, and the lower stopper 58 of the rod 46 will move towards the sleeve head 52. Before the piston 2 will reach the top dead center, i.e., at a length equal to the diameter of inlet ports 9, 35 and 38, below the top dead center, the lower stopper 58 will start pushing the sleeve 30 up. The sleeve 30 will be pushed up till the piston 2 reaches the top dead center. At the top dead center, the sleeve 30 will be fixed in its upper position. Now the upper inlet ports 8, 32 and 39 and the lower outlet ports 11, 34 and of 37 will be open and will be ready for the down stroke of the piston. The sleeve 30 will be moved up through a length equal to the diameter of the ports. will knock the sleeve 30 into its upper and lower positions respectively.

Up Stroke of the Piston

As the rod 46 will be threaded to the piston face 44 via 47 and 49, it will slide through the cylinder head 48, upward during the up stroke of the piston (see FIG. 5). the lower inlet ports 9, 35 and 38 of cylinder 16 and inlet ports 18, 40 and 41 will be open. Drilling mud 26 from the drill string will enter the lower inlet port 9 and push the piston 2 up. Simultaneously, the drilling mud above the piston 2 will be forced out through the upper outlet ports 12, 33 and 36. Also, mud is sucked in from chamber 14 into smaller cylinder 6 through ports 18m 40 and 41. The piston now will move up, along with sliding rod 46 up through the cylinder head 48.

When the rod 46 moves up, the upper stopper 56 of the rod 46 will move away from the sleeve head 52, and the lower stopper 58 of the rod 46 will move towards the sleeve head 52. Before the piston 2 will reach the top dead center, i.e., at a length equal to the diameter of inlet ports 9, 35 and 38, below the top dead center, the lower stopper 58 will start pushing the sleeve 30 up. The sleeve 30 will be pushed up till the piston 2 reaches the top dead center. At the top dead center, the sleeve 30 will be fixed in its upper position. Now the upper inlet ports 8, 32 and 39 and the lower outlet ports 11, 34 and 37 will be open and will be ready for the down stroke of the piston. The sleeve 30 will be moved up through a length equal to the diameter of the ports.

Down Stroke of The Piston

The upper inlet ports 8, 32 and 39 and the lower outlet ports 11, 34 and of 37 cylinder 16 will be open and the inlet ports 18, 40 and 42 of the smaller cylinder 6 will be closed. Drilling mud 26 from the drill string will enter the upper inlet ports 8, 32 and 39, and push the piston 2 down. Simultaneously, the drilling mud below the piston 2 will be forced out through the lower outlet ports 11, 34, and 37. The piston 2 now will move along with the sliding rod 46, down through the cylinder head 48.

Figure 6:
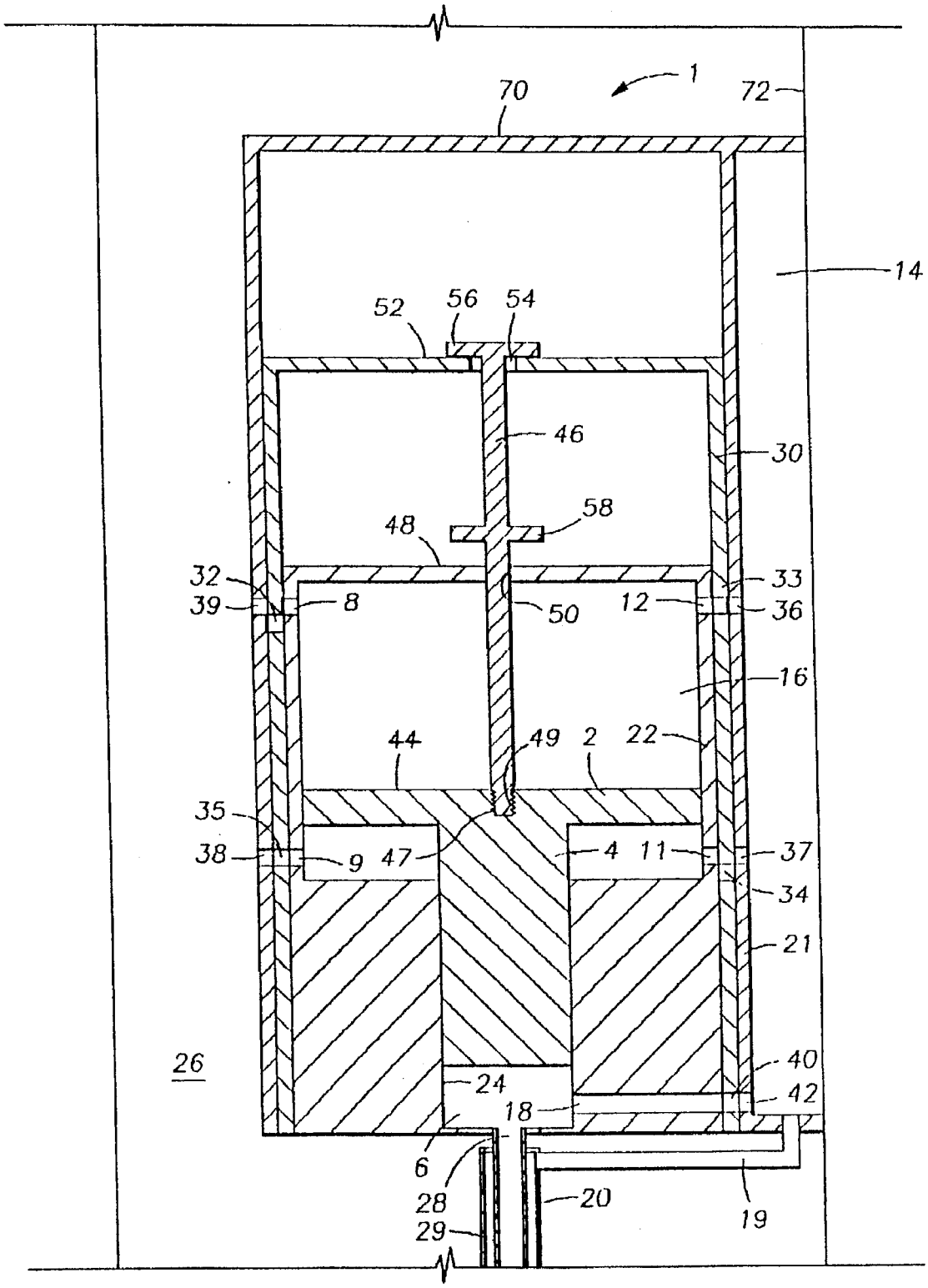
FIG. 6—Cross-sectional elevational view of the present invention with sleeve mechanism in downward most position.

When the rod 46 moves down, the lower stopper 58 of the rod 46 will move down and away from the sleeve head 52, and the upper stopper 56 of the rod 46 will move down and towards the sleeve head 52. Before the piston 2 will reach the bottom dead center, i.e., at a length equal to the diameter of inlet port 8, above the bottom dead center, the upper stopper 56 will start pushing the sleeve 30 down (see FIG. 6). The sleeve 30 will be pushed down till the piston 2 reaches the bottom dead center. At the bottom dead center, the sleeve 30 will be fixed in its lower position. Now the lower inlet ports 9, 35 and 38 and the upper outlet ports 12, 33 and 36 will be open and will be ready for the up stroke of the piston. The sleeve 30 will be moved down through a length equal to the diameter of the ports 8 and 39.

Figure 7:
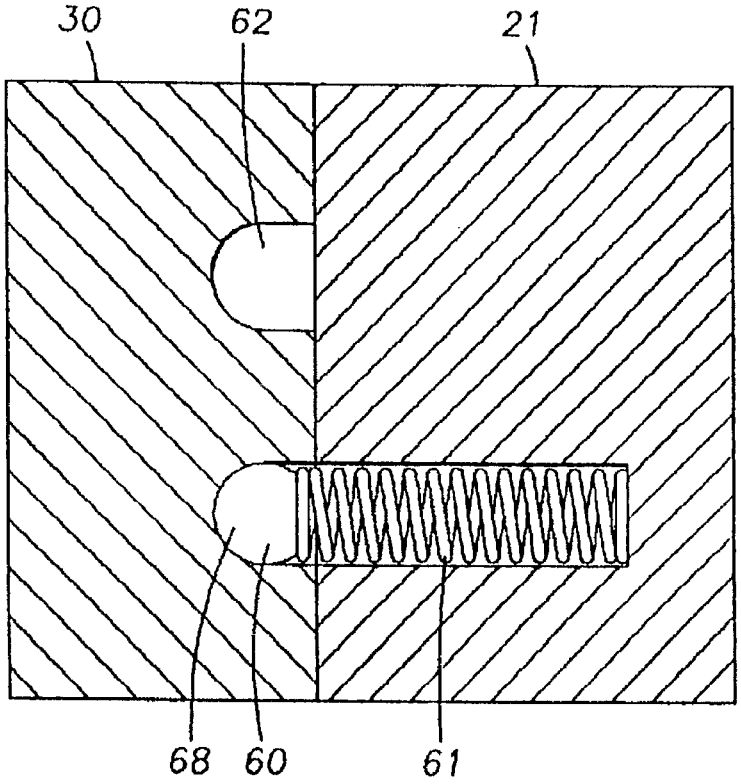
FIG. 7—Cross-section view of spring and ball locking mechanism of the present invention.

The sleeve 30 will be fixed in its two positions with a ball and socket arrangement. Two sockets 60 and 62 will be machined at the inner surface of the sleeve 30, respectively for the upper and lower positions (see FIG. 7). The cylinder body 21 will have a hole 64 drilled in its body to accommodate a spring 61 and a ball 68. The spring 66 will push the ball 68 into the sockets 60 and 62 cut in the sleeve 30 and will hold it in position. FIG.7 shows this arrangement for the two positions of the sleeve, the upper and lower position. In operation the ball 68 is pressed into one of the sockets 62 or 60 by virtue of spring 61. When sleeve 30 is moved by virtue of the rod stops 56 or 58 the ball 68 is forced into the slot 64 which contains spring 61 said ball 68 then being forced back into the socket 60 or 62 for the new position.

Figure 8:
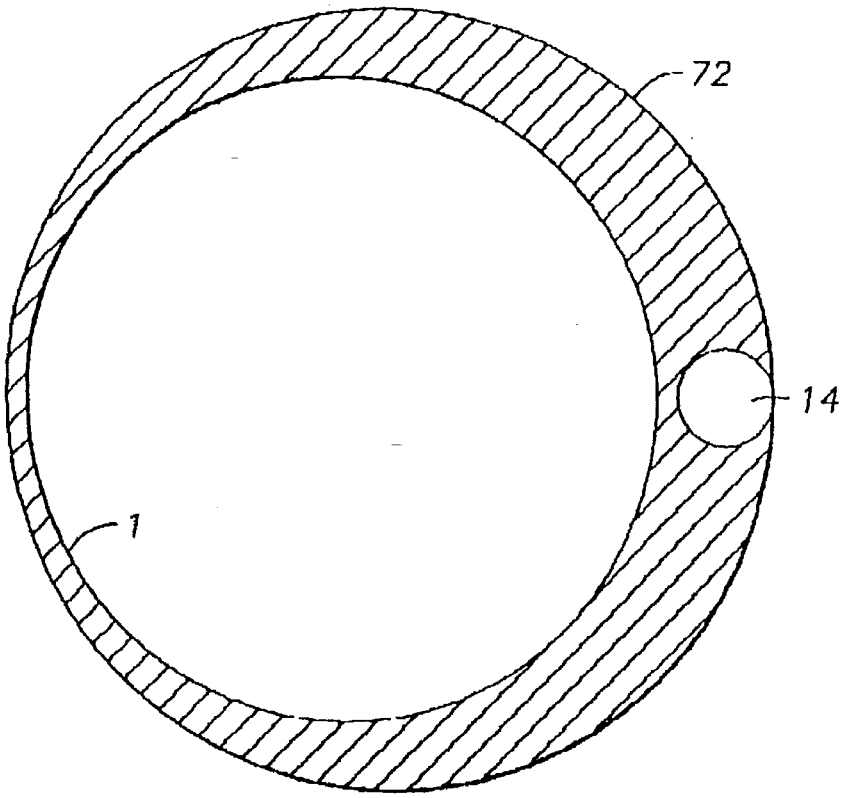
FIG. 8—Plan view of down hole tool of the present invention.

The overall arrangement of the present invention within a drill collar is shown in FIG. 8. The drill collar 72 surrounds the cylinder piston arrangement of the present invention 1, as well as the chamber 14.

The Outlets from the Tool

Figure 9:
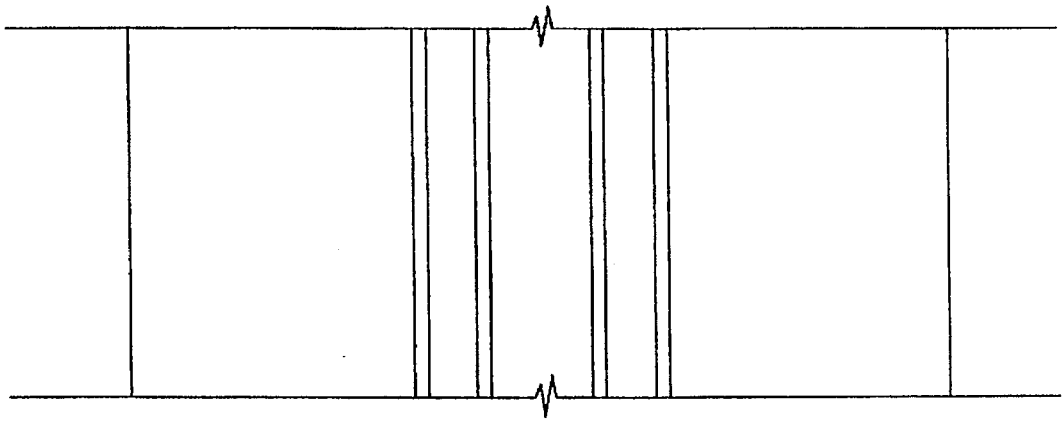
FIG. 9—Schematic of outlets of the present invention.

There will be three outlets from the tool viz. the high pressure outlet 28 from the smaller cylinder 6, the outlet 19 from the chamber 14, and the conventional mud stream 26 (see FIG. 9). The first two outlets will be in two concentric pipes. The inner pipe 29 will carry the high pressure outlet and the annulus (outer pipe) will carry the outlet from the chamber 14. The annulus space between this concentric pipe and the drill collar will be the conduit for the normal drilling fluid in the drill string. The concentric pipe will extend till the box joint of the down hole tool (not shown).

Figure 10:
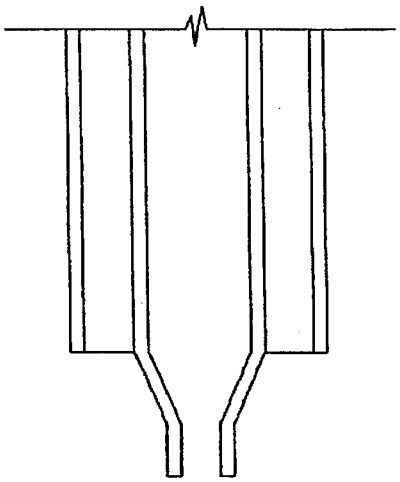
FIG. 10—Schematic of nozzle arrangement on the drill bit with concentric pipes of the present invention.

The down hole tool will be attached to a drill bit. The drill bit should be modified with the inclusion of special jet nozzles 10 for the high pressure nozzle 10 will be placed concentric to the opening for the outlet from the annulus 20 (see FIG. 10). The opening and nozzle assembly will be fitted to two concentric pipes. The inner pipe will be connected to the jet nozzle 10 and the annulus or outer pipe will be connected to the opening. This concentric pipe will extend up to the threads on the pin joint of the drill bit.

Figure 11:
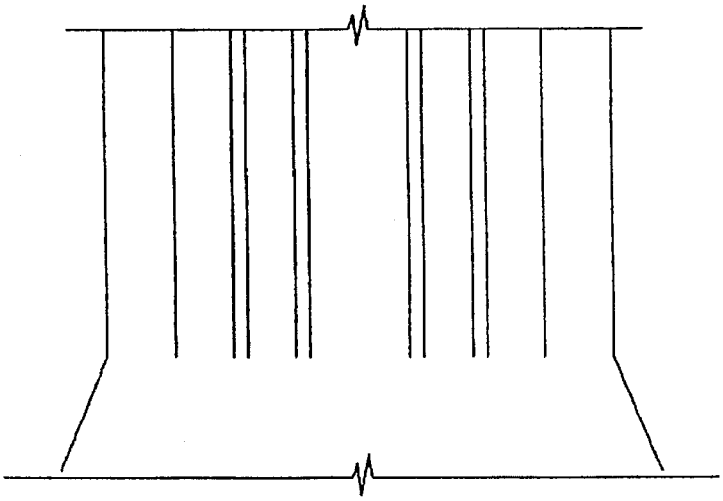
FIG. 11—Schematic of down hole tool of the present invention and drill bit connection.

The concentric pipes of the down hole tool and the drill bit should be provided a stab seal design for their connection (see FIG. 11). The drill bit when made up with the down hole tool, the concentric pipes within them will be automatically be connected.

The Mud Cleaning Device

At a pressure of 35,000 psi, the smaller cylinder 6 and piston 4 can get mud cut (be worn away by the abrasiveness of the mud). It is imperative to clean the mud and remove solid particles before it enters the small cylinder. Alan D. Peters had used 2–20 microns cleaning filters for the Lance SM Formation Penetrator. A similar filter would be ideal in this case. The location of the filter will be at the inlet of the smaller cylinder, so that only the clean filtrate will enter the smaller cylinder. During the down stroke, no mud enters the smaller cylinder because its inlet will be in the closed position. The mud will exit the lower outlet and flow through the chamber. During its flow, the mud will pass around the filter and remove the solid particles that were entrapped during the suction stroke. This will ensure the smooth functioning of the filter.

SIZING AND CALCULATIONS OF THE DOWN HOLE TOOL

The first generation tool will be designed for a 13.25" pipe diameter. After the fabrication and testing of this tool this tool can be designed for smaller diameter holes. The sizing and design of this tool will be based on various findings of Summers and Mike Cure. Their work has proved the effects of some of their chosen parameters like the pressure at the jet nozzle, the size of nozzles, and the discharge through the nozzles. The calculations will proceed with these parameters as a primary basis. The space restrictions, and the power available will be the secondary basis.

The power available to drive this tool will basically be the operating pressure of the mud pumps. A practically feasible mud pump pressure will be approximately 3000 psi. So the design and sizing of this tool will be based on a driving pressure of 3000 psi, i.e., the pressure available to drive the larger piston 2. The final goal will be to produce a pressure of 35,000 psi at the special jet nozzle.

Due to the abrasive nature of the fluid that will be handled and the abusive down hole conditions the velocity of the piston arrangement will be restricted to 1 if/sec.

The velocity of the fluid in the small cylinder 6=1 ft/sec,

The discharge required through the nozzle 10=20 gal/min–Q,

The diameter of one nozzle 10=0.0338 in.–$D_n$,

The jet nozzle 10 velocity=1450 ft/sec–$V_n$,

Number of high pressure jet nozzles 10 on the bit=5,

The driving pressure=3000 psi–$P_1$,

The pressure required at the jet=35,000 psi–$P_2$, $$\text{Area of one nozzle } A_n = \frac{}{4} \times D_n^2 = \frac{3.141}{4} \times 0.0338^2$$

-continued $$\text{Total area of nozzles} \quad A_{nt} = A_n \times 5 = 8.96 \times 10^{-4} \times 5$$

$$A_{nt} = 4.48 \times 10^{-3} \text{ sq in.}$$

Let $A_1$ be the cross-sectional area of the smaller cylinder $$A_1 \times V_1 = A_{nt} \times V_n$$

$$A_1 = \frac{4.48 \times 10^{-3}}{1} \times 1450$$

$$A_1 = 6.496 \text{ sq in.}$$

$$\text{The ratio in pressure increase} \quad R = \frac{35000}{3000}$$

$$R = 11.7.$$

Let $A_2$ be the cross-sectional area of the smaller cylinder $$A_2 = 11.7 \times A_1 = 11.7 \times 6.496$$

$$A_2 = 76.0032 \text{ sq in.}$$

Let $D_1$ be the diameter of the smaller cylinder 6 and $D_2$ be the diameter of the bigger cylinder 16.

$$D_1 = 2 \times \frac{A_1}{\pi} = 2 \times \frac{6.496}{\pi} = 2.875 \text{ in.}$$

$$D_2 = 2 \times \frac{A_2}{\pi} = 2 \times \frac{76.0032}{\pi} = 9.8 \text{ in.}$$

Therefore, the diameter of the smaller cylinder 6=9.8 in.

The stroke length=24 in.

The inlet and outlet port diameters=1 in.

The port diameters are arbitrarily selected to minimize pressure losses.

Figure 12:
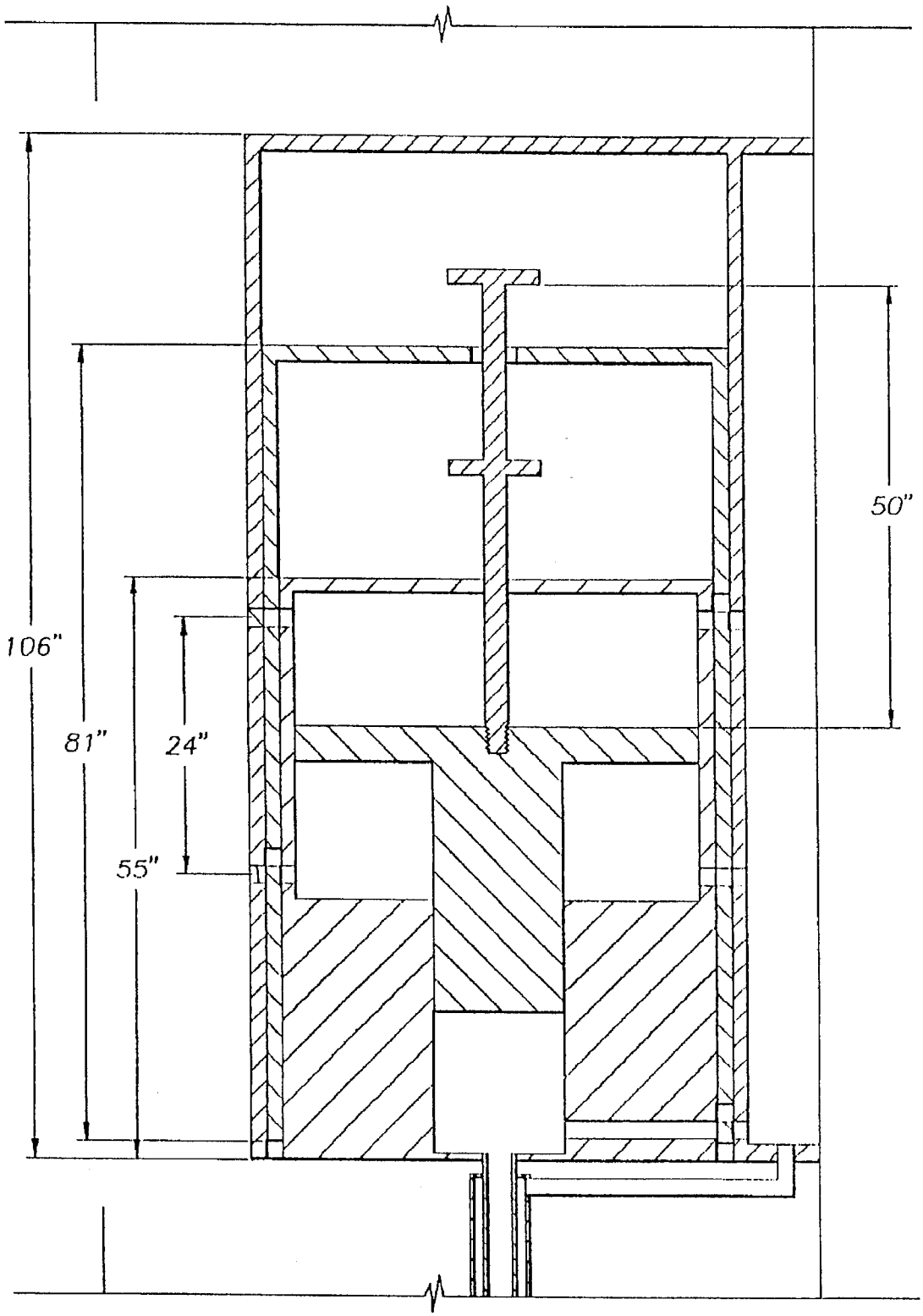
FIG. 12—Dimensions of preferred embodiment of down hole tool.
Figure 13:
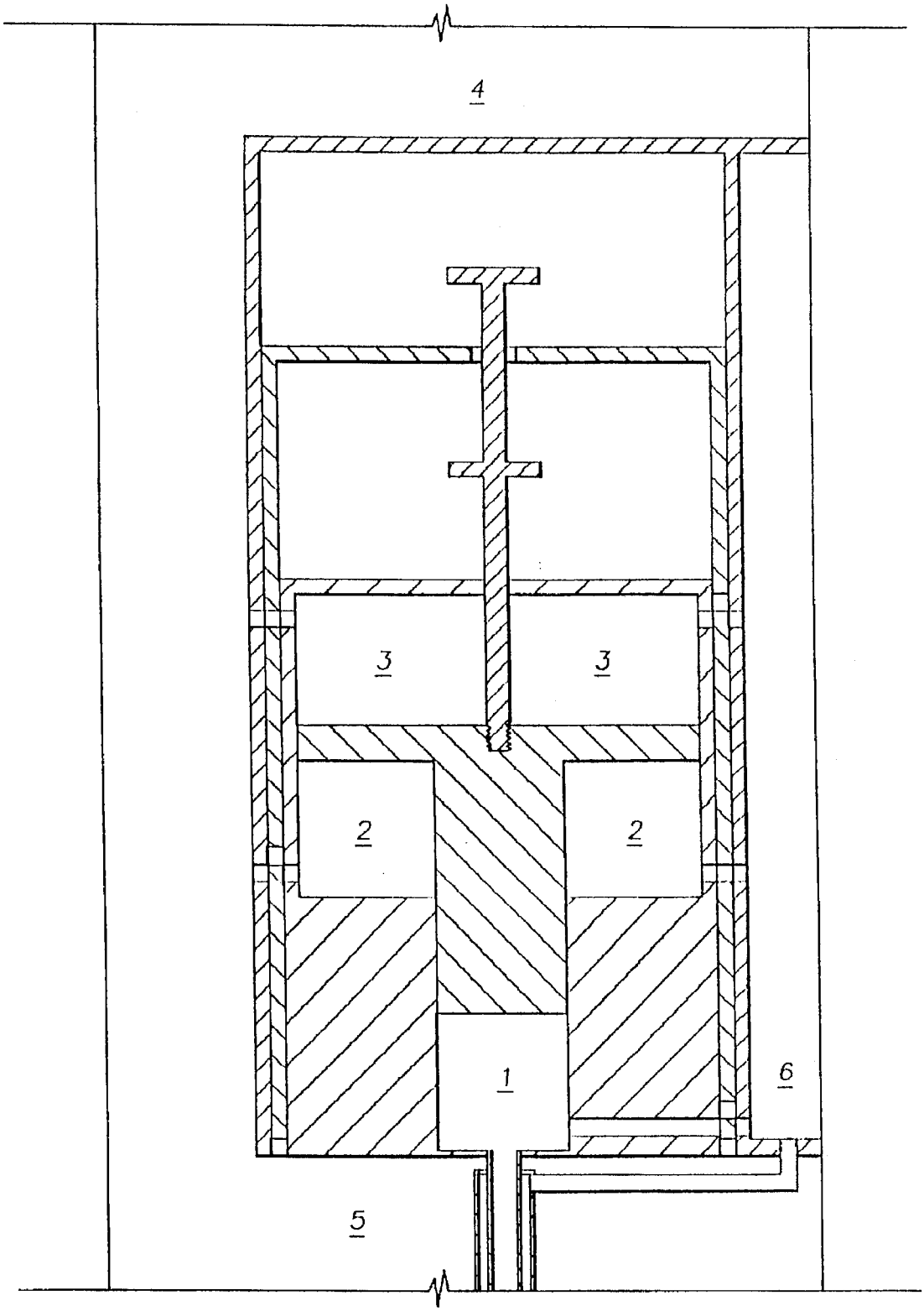
FIG. 13—Figure relating to and disclosing power balance measurements for present invention.

The sleeve 30 movement from its lower position to its upper position will be equal to the port diameters (See FIG. 12). The cylinder length to accommodate the stroke length will be 55 in.

$$\text{Diameter of the cylinder} = \text{diameter of the larger piston} + (2 \times \text{wall thickness}) = 9.8 + (2 \times 0.4) = 10.6 \text{ inc.}$$

The length of the rod will be 50 in. FIG. 12 shows the length of rod 46 will have to be at least 50 in. to allow the stoppers 56 and 58 to reciprocate above the cylinder head 48 only. The lower stopper 58 will be fixed at a distance of 27 in. from the top of the piston 2. This distance will be minimum required so that when piston 2 is at its bottom dead center the lower stopper 58 is just above (a clearance of 1 inc. is provided) the cylinder head 48. The upper stopper 56 will be fixed at a distance of 23 in. from the lower stopper 58. This length is again required to push the sleeve 30 at the appropriate point of time.

The length between the sleeve head 52 and the cylinder head 48 (the over hang of the sleeve) will have to be 25 in. This length is equal to the stroke length of the piston plus the clearance between the lower stopper 50 and the cylinder head 48 when the piston is at the bottom dead center (see FIG. 12).

| | | |
|---|---|---|
| The length of the sleeve 30 | = | length of the overhang + the clearance + the length of the cylinder. |
| | = | 25 + 1 + 55 |
| | = | 81 in. |
| (Inner diameter of the sleeve | = | outer diameter of the cylinder |
| | = | 10.6 in. |
| Outer diameter of the sleeve | = | inner diameter of the sleeve + (2 × wall thickness) |
| | = | 10.6 + (2 × 0.25) |
| | = | 11.1 in. |

The length of container 70 will be dictated by the rod protrusion above the cylinder head 48 when the piston will be in the top dead center.

The time for one stroke will be 2 secs and the stroke length will be 24 in.

$$V_1 = \frac{p \times 2.875^2}{4} \times 24 = 155.8 \text{ in}^3,$$

$$Q_1 = \frac{155.8 \text{ in}^3}{2 \text{ secs}} \times 0.004329 \frac{\text{gas}}{\text{in}^3} \times 60 \frac{\text{sec}}{\text{min}} = 20.23 \text{ gal/min.}$$

In the above equation 0.004329 is a conversation constant from cubic inch to gallons and 60 is to convert seconds to minute.

$$V_2 = \frac{p}{4} \times (9.8^2 - 2.875^2) \times 24 = 1654.51 \text{ in}^3,$$

$$Q_2 = \frac{1654.51}{2} \times 0.004329 \times 60 = 214.8 \text{ gal/min,}$$

$$V_3 = \frac{p}{4} \times 9.8^2 \times 24 = 1810.31 \text{ in}^3,$$

$$Q_3 = \frac{1810.31}{2} \times 0.004329 \times 60 = 325.1 \text{ gal/min.}$$

Normally, the rate of discharge of drilling mud during a routine drilling operation will be 400 gal/min.

$$Q_4 = 400 \text{ gal/min}$$
$$Q_5 = Q_4 - Q_3 = 400 - 235.1 = 165 \text{ gal/min}$$

$$Q_6 = \frac{(V_3 + V_2 - V_1)}{4 \text{ secs}} \times 0.004329 \times$$

$$60 = \frac{(1810.31 + 1654.51 - 155.8)}{4} \times 0.004329 \times 60 = 214.9 \text{ gal/min.}$$

The power balance will be calculated at two conditions, one during the down stroke and the other during the up stroke.

Power Balance during the down stroke

Let the pressure $P_1$ available at the tool to drive the bigger piston be 8000 psi (the hydrostatic pressure plus the operating pressure). Let the operating pressure be 3000 psi and the hydrostatic pressure 5000 psi. The back pressure P that will act against the driving of the piston will be the hydrostatic pressure, 5000 psi.

The hydraulic horse power associated with the drilling mud at position 4 will be split into two streams, one the high pressure stream and the other the conventional stream.

$$\text{The hydraulic horse-power} = \frac{Q \times \text{Pressure}}{1714} \text{ HP}$$

Power available at 4 = (power at 3) − (power at 2) + (power at 5) + (power at 7)

$$\frac{400 \times 8000}{1714} = \frac{235.1 \times 8000}{1714} - \frac{214.8 \times 5000}{1714} + \frac{165 \times 8000}{1714} + \frac{214.9 \times 5000}{1714}$$

1866.98 = 1097.32 − 626.6 + 770.13 + 626.89
1866.98 = 1867.74

The right-hand side in actual situation will be less than the left-hand side, because of friction.

Regarding the power at position 3 and at position 2 the power at position 3 should be more than power at position 2 to drive the piston down. At position 3, the pressure will be 8000 psi since it will be in communication with the main mud stream in the drill string. At position 2, the pressure will be 5000 psi since it will be in communication with the annulus.

| | | |
|---|---|---|
| The piston driving power during down stroke | = | (power at 3) − (power at 2) |
| | = | $\frac{235.1 \times 8000}{1714} - \frac{214.8 \times 5000}{1714} - \frac{20 \times 5000}{1714}$ |
| | = | 1097.32 − 626.6 − 58.34 |
| | = | 412.36 HP. |
| The pressure associated with this 20 gal/min of mud | = | $\frac{412.36 \times 1714}{20}$ |
| | = | 35339 psi. |

This pressure is almost equal to the pressure $P_3$ calculated using the ratio of the areas of the two pistons.

Therefore, 412.36 HP will be available to drive the piston downward. Neglecting friction this power will be transmitted to the fluid at position 1. This proves the theoretical feasibility of the tool Ultimately the tool should accomplish the task of creating a stream of 20 gallons per min of mud at 470 HP from a main stream of 400 gallons per minute of mud at 1867 HP.

Power balance during the up stroke

The numbers used above will be used again in this section.

Power at 4 = (power at 5) + (power at 2) − (power at 3) + (power at 6)

$$\frac{400 \times 8000}{1714} = \frac{(400 - 214.8) \times 8000}{1714} + \frac{214.8 \times 8000}{1714} - \frac{235.1 \times 5000}{1714} + \frac{235.1 \times 5000}{1714}$$

The right-hand side in actual situation will be less than the left hand side, because friction.

Regarding the power at position 3 and at position 2, the power at position 3 should be more than power at position 2 to drive the piston up. At position 3 the pressure will be 5000 psi since it will be in communication with the annulus. At position 2 the pressure will be 8000 psi since it will be in communication with the main mud stream in the drill string.

$$\text{The piston driving power during up stroke} = (\text{power at 2}) - (\text{power at 3})$$

$$= \frac{214.1 \times 8000}{1714} - \frac{235.1 \times 5000}{1714}$$

$$= 1002.57 - 685.82$$

$$= 316.75 \text{ HP.}$$

Therefore, 316.75 HP will be available to drive the piston upward. neglecting friction this power will be transmitted to the fluid at position 2 and forces the mud into the chamber against the back pressure provided by the annulus.

I claim:

1. A down hole pressure pump comprising:

a. A container;

b. A first cylinder defined by a cylinder wall, mounted within said container;

c. Upper and lower inlet and outlet ports formed in said first cylinder;

d. Upper and lower inlet and outlet ports formed in said container corresponding to the inlet and outlet ports of said first cylinder;

e. A second cylinder integrally formed below said first cylinder said second cylinder containing an inlet port and an outlet port;

f. A large piston complementary to the interior of said first cylinder affixed to a smaller piston complementary to the interior of said second cylinder; and g. A chamber with first and second inlet ports and first and second outlet ports said first inlet and outlet ports each communicating to said first cylinder while said second inlet port communicates to said first cylinder so as to allow the chamber to accept and return fluid from said first cylinder and, to accept fluid from said second cylinder and release fluid away from said entire pump through said second outlet;

h. Means for filling said first cylinder with drilling mud so as to force said larger and smaller piston upward and then downward such that the fluid from said chamber is drawn into said second cylinder said fluid being forced out said second cylinder outlet when said drilling mud forces said larger piston downward.

2. The invention of claim 1 wherein said means for filling said first cylinder with drilling mud comprises:

a. A cylinder head formed as part of said first cylinder;

b. A sleeve slidably mounted between said container and said first cylinder;

c. A sleeve head formed as part of said sleeve;

d. A piston rod attached to the center point of said larger piston said piston rod extending upwardly perpendicularly therefrom and through said cylinder head and sleeve head;

e. Upper and lower stoppers said upper stopper at the distal end said rod from side larger piston and whereupon when said larger piston is in its lower most position said upper stopper comes in contact with said sleeve head forcing said sleeve downward;

f. Said lower stopper being formed below said sleeve head and placed so that when said larger piston is at its upper most point said lower stopper comes in contact with said sleeve head forcing said sleeve upward; and g. Ports formed in said sleeve positioned such that when said sleeve is in its upper position said first cylinder inlet is open so as to allow drilling mud into said first cylinder and said lower outlet to said chamber is opened such that when said larger piston is forced downward said drilling fluid in said first cylinder is forced into said chamber simultaneously with drilling fluid in said second cylinder being forced outward through said small cylinder outlet.

3. The invention of claim 1 wherein:

a. Sockets are formed in said sleeve corresponding to said upper and lower positions; and b. A slot is formed in said first cylinder wall on the outside thereof so as to accommodate a spring and ball, said ball corresponding to and being forced into said socket in said sleeve by said spring so as to maintain said sleeve in said upper or lower position until forced to the other position by the pressure of the drilling fluid filling said first cylinder.

4. The invention of claim 1 wherein said second outlet of said chamber and said outlet of said second cylinder form concentric circles with the output of said second cylinder formed being maintained within said output of said chamber.

5. The invention of claim 1 wherein said second cylinder outlet port is connected to a single nozzle.

6. The invention of claim 1 wherein said second outlet port of said chamber communicates to the outside of the drill string a direct conduit.

7. The invention of claim 2 wherein said cylinder wall defines said first cylinder and said second cylinder.

8. The invention of claim 7 wherein said cylinder wall is in one piece.

* * * * *